United States Patent [19]

Ogura et al.

[11] Patent Number: 4,490,132

[45] Date of Patent: Dec. 25, 1984

[54] PAPER FOLDING MACHINES FOR USE IN ROTARY PRESSES

[75] Inventors: Daisuke Ogura, Yamato; Shosuke Fujiu, Kawaguchi, both of Japan

[73] Assignees: Toshiba Kikai Kabushiki Kaisha; Toppan Printing Co. Ltd., both of Tokyo, Japan

[21] Appl. No.: 536,571

[22] Filed: Sep. 28, 1983

Related U.S. Application Data

[63] Continuation of Ser. No. 262,909, May 12, 1981, abandoned, which is a continuation of Ser. No. 41,490, May 22, 1979, abandoned.

[30] Foreign Application Priority Data

May 26, 1978 [JP] Japan ..... 53-62929

[51] Int. Cl.[3] ..... B65H 45/16

[52] U.S. Cl. ..... 493/424; 270/42; 270/47; 493/432

[58] Field of Search ..... 493/424–432; 270/6, 10, 13, 14, 19, 38, 42–44, 47–50, 60

[56] References Cited

U.S. PATENT DOCUMENTS

| | | | |
|---|---|---|---|
| 2,991,995 | 7/1961 | Zuckerman | 493/429 X |
| 3,026,106 | 3/1962 | Bouldin | 270/5 |
| 3,026,107 | 3/1962 | Stroud | 270/58 |
| 3,653,656 | 4/1972 | Stobb | 271/202 X |
| 3,784,187 | 1/1974 | Takayanagi | 493/362 X |

FOREIGN PATENT DOCUMENTS

| | | | |
|---|---|---|---|
| 1204689 | 11/1965 | Fed. Rep. of Germany | 493/432 |
| 1801419 | 9/1970 | Fed. Rep. of Germany . | |
| 2517000 | 10/1976 | Fed. Rep. of Germany . | |
| 339226 | 8/1959 | Switzerland | 493/432 |

OTHER PUBLICATIONS

"Der Tiefdruck, seine Verfahren und Maschinen" (Intaglio Printing, its Processes and Apparatus), A. Braun, Publisher, Polygraphverlag, (1952), pp. 198 to 211.

"Atlas des Zeitungs—und Illustrationsdruckes", von Alexander Braun, Polygraph-Verlag 1960, p. 107.

*Primary Examiner*—A. J. Heinz

*Attorney, Agent, or Firm*—Frishauf, Holtz, Goodman & Woodward

[57] ABSTRACT

A paper folding machine comprises a slitter for longitudinally slitting a web of printed paper into two halves, a pair of triangular plates for longitudinally folding slitted halves of the web, a cutting drum for transversely cutting the folded halves into sheets of papers, an overlapping drum, a belt conveyor for conveying the sheets of printed papers from the cutting drum to the overlapping drum and for clamping the sheets between the overlapping drum and the belt conveyor, a gripping drum which receives the sheets from the overlapping drum and folds the sheets, and a delivery drum which receives the sheets from the overlapping drum and delivers the sheet to a stacking station. The gripping drum and the delivery drum are selectively operated depending upon whether sheets or sections of printed papers are delivered.

10 Claims, 22 Drawing Figures

PAPER FOLDING MACHINES FOR USE IN ROTARY PRESSES

This application is a continuation of application Ser. No. 262,909, filed May 12, 1981, which is a continuation of U.S. Ser. No. 041,490, filed May 22, 1979, both now abandoned.

BACKGROUND OF THE INVENTION

This invention relates to a paper folding machine for use in a rotary press provided with a sheet delivery device.

The prior art paper folding device for use in a rotary press provided with a sheet delivery device comprises a cutting unit which cuts a web of printed paper into sheets of painted paper having a predetermined length, a folding device which folds the paper sheets and delivers folded paper sheets on a paper conveyor, (if necessary, the sheets are folded by a chopper) and a sheet delivery device which discharges the sheets in a stacked state. The folding device is constructed to discharge in different directions the sheet and folded sections, if desired.

The cutting unit comprises a cutting drum and a folding drum which are constructed to catch printed paper with needles of the folding drum to wrap the paper about the folding drum and to cut the paper into sheets having a predetermined length with a knife of the cutting drum when the paper has rotated a predetermined angle about the folding drum.

With such construction, however, when post printing the printed paper with a sheet-by-sheet rotary press for the purpose of printing catalogues or the like it is necessary to remove needle openings of the printed paper, that is to trim the paper for improving appearance. Furthermore, to fold the printed papers for binding books it is necessary to trim needle margins (usually 6 to 10 mm). As above described, even when the printed papers are discharged after folding or not folding, it is necessary to remove needle openings or needle margins in a succeeding step. For this reason, it is necessary to provide an additional cutting device.

Furthermore, in a prior art printing machine, since folded papers and unfolded papers are discharged in different directions, it is necessary to install a control device for aligning the cutting position with respect to the printed paper surface and to align printed colours, near the folding device or the paper delivery device thus requiring a large floor space.

SUMMARY OF THE INVENTION

Accordingly, it is an object of this invention to provide an improved paper folding machine which does not use a needle device for delivering sections or sheets of printed papers so that it is possible to eliminate a trimming step for removing needle openings thus simplifying the construction.

Another object of this invention is to provide an improved paper folding machine constructed to deliver the sections and sheets of printed papers in the same direction thereby simplifying the construction.

A further object of this invention is to provide a paper folding machine capable of delivering sheets of printed papers having a width equal to or one half of the width of a web of printed paper entering into the folding machine.

According to this inventiion there is provided a paper folding machine for use in a rotary press comprising a cutting unit which cuts a web of printed paper into a plurality of sheets of printed papers each having a predetermined length; a conveyor unit for clamping and conveying the sheets of printed papers; an overlapping drum including a long finger, a short finger and an insertion spatula which are operated by cam means to overlap and grip one or a plurality of the sheets of printed papers conveyed by the conveyor unit, a gripping drum positioned adjacent the overlapping drum for gripping and folding the sheets of printed papers; a sheet delivery drum positioned adjacent the overlapping drum for receiving one or a plurality of sheets of printed papers from the overlapping drum and for gripping and delivering the sheets of printed papers; and paper delivery means disposed adjacent the gripping drum and/or the delivery drum.

DESCRIPTION OF THE PREFERRED EMBODIMENTS

Figure 1:
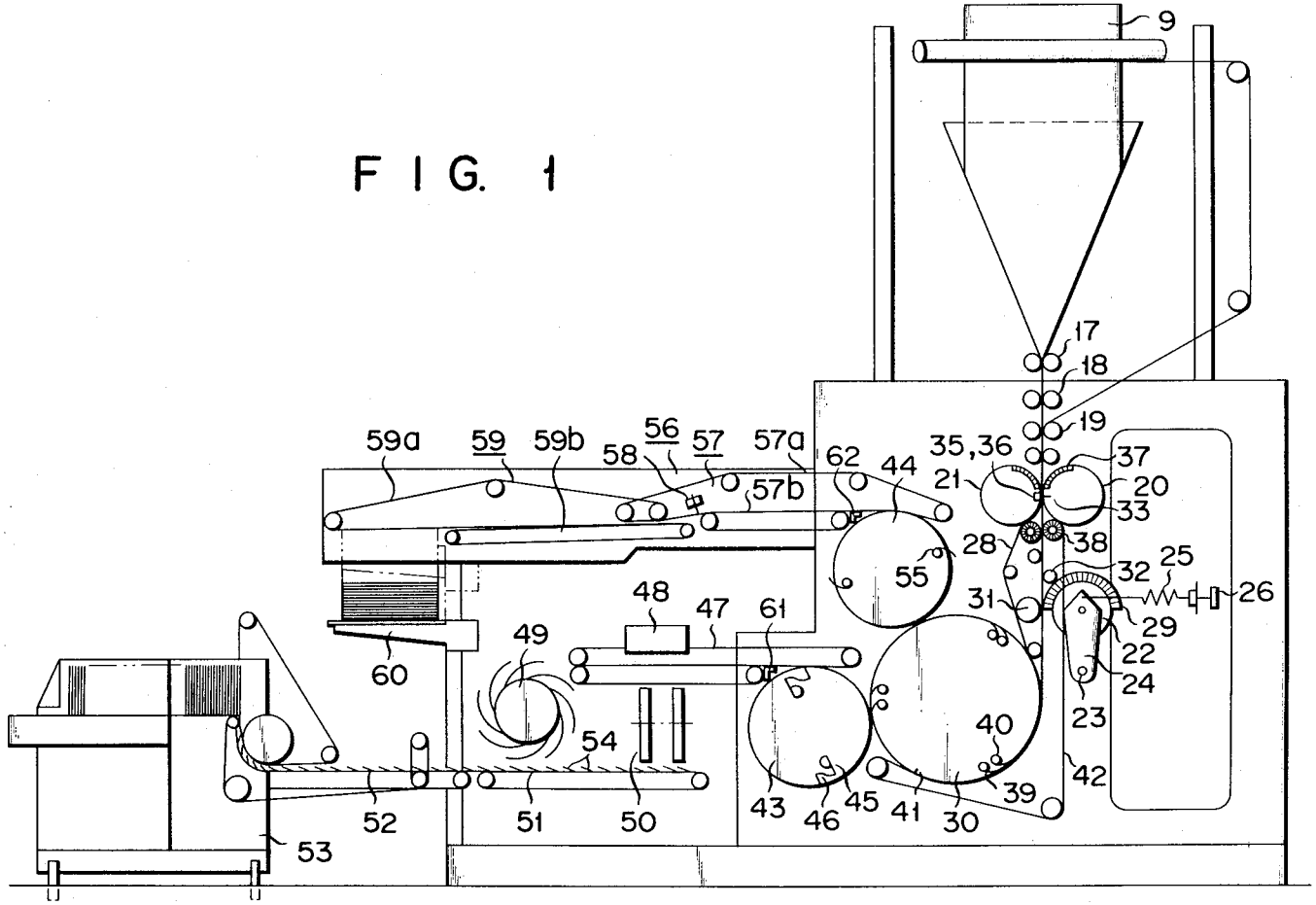
FIG. 1 is a diagrammatic side view of one embodiment of the printed paper folding machine of this invention for use in a rotary press.

In the accompanying drawings, a web of printed paper 9 is advanced by drag rollers 11 and 19 and its direction is changed by a turn bar 10. The printed paper 9 is slitted in the longitudinal direction on the drag roller 11 by a slitter 12 located at about the middle of width of the paper. When the slitter 12 is not used, it may be separated away from the surface of the paper 9. Correction rollers 13 which are movable in the vertical and horizontal directions are provided for the purpose of aligning the transverse cutting direction of the paper 9 with the operating position of a cutting blade 33 of a cutting drum 20. Guide rollers 14 are provided to change the direction of movement of the printed paper 9. There are also provided opposed left and right triangular plates 15 and 16 with their apices directed downwardly. When the printed paper 9 is slitted by the slitter 12, webs of printed papers **9*a* and 9*b* each having a one half width are guided to the left and right triangular plates 15 and 16 respectively to be folded thereby. Two pairs of leading rollers 17 are positioned at the apices of the triangular plates 15 and 16 to press the folds of the folded paper between the rollers to prevent crimples. Beyond the leading rollers 17 are provided nipping rollers 18 which hold the paper 9**.

Figure 3:
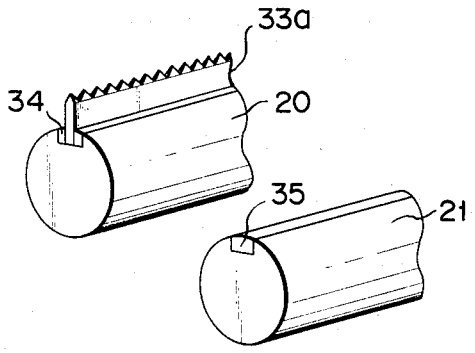
FIGS. 3 and 4 are perspective views showing different types of a cutting drum and a receiving drum which constitute the cutting unit utilized in the embodiment shown in FIG. 1.
Figure 4:
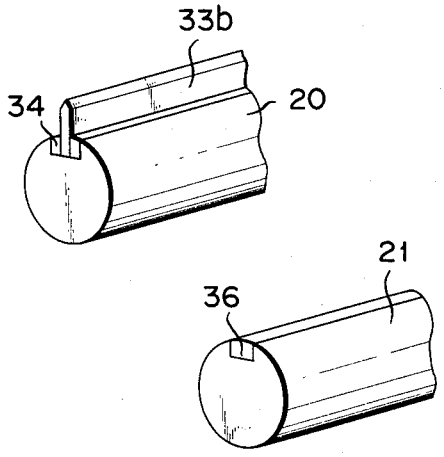

The cutting unit of the web of the printed paper comprises a cutting drum 20 and a receiving drum 21 cooperating therewith. The cutting blade of the cutting drum 20 may saw or cut through the paper. Thus, in the case of sawing, a cutting blade 33*a* as shown in FIG. 3 is used in which the base portion of a saw blade 33*a* is secured to the cutting drum 20 by rubber pieces 34 and a receiving pad 35 made of hard rubber for example, is fastened to the receiving drum 21 cooperating with the cutting drum. In the case of the cut through type, as shown in FIG. 4, the base portion of a straight blade 33*b* is secured to the cutting drum 20 by rubber pieces 34 and a receiving pad 36 made of a hard plastic or metal is secured to the receiving drum 21.

In this manner, the cutting blade and the receiving pad of the cutting drum 20 and the receiving drum 21 can be readily mounted and dismounted and the straight blade 33*b* and the saw blade 33*a* are exchangeable.

The speeds of the cutting drum 20, the receiving drum 21 and of the conveyor unit succeeding these drums are increased over the peripheral speed of the platen drum of the printing unit so that the long finger 39 and the short fingers 40 of an overlapping drum 30 to be described later will form a suitable gap necessary to grip sheets of printed paper 27. In this embodiment, the speeds of the cutting drum, etc, are made to be about 15% higher than the peripheral speed of the platen drum.

Furthermore, in order to cut transversely the web of the printed paper once per one revolution of the platen drum of the printing unit, the diameter $D_1$ of the cutting drum 20 and the receiving drum 21 is selected to be equal to (diameter D of the platen drum)×(percentage of speed increase) (1.15).

A timing roller 22 having the same diameter as the cutting drum 20 and the receiving drum 21 and rotatable in synchronism therewith is mounted on an arm 24 pivotally supported by a pin 23 and the pressure of the timing roller 22 against the web of the printed paper 9 or a sheet of printed paper 27 is adjusted by a spring 25 and a knob 26. The timing roller 27 is disposed on the downstream side of the cutting drum 20 and the receiving drum 21 in a range of a cut length of the web of the printed paper 9. A resilient member 29 made of rubber or the like is mounted on the periphery of the timing roller 22. The purpose of the resilient member 29 is to clamp the leading edge of the paper 9 at the time of cutting and to positively feed cut paper sheet 27 to an overlapping drum 30. In this embodiment, the length of the resilient member 29 is made to be one half of the peripheral length of the timing roller 22, but this length may be varied as desired. A metal pull roller 31 rotated at the same speed as the timing roller 22 is disposed to oppose thereto for feeding printed paper sheets to the overlapping drum 30. Belt clamping rollers 32 are used to clamp the web of printed paper 9 and the sheets of printed paper 27 between conveyor belt 28 and a belt 42. Brushes 37 are secured to the peripheries of the cutting drum 20 and the receiving drum 21 in front of the cutting blade 33 and the receiving pads 35 or 36, respectively for the purpose of preventing the leading edge of the web of the printed paper 9 from wrapping about the cutting drum 20 and the receiving drum 21 when the paper is cut. A pair of brush rollers 38 are rotated by the conveyor belt 28 and the belt 42 respectively to contact the outer peripheries of the cutting drum 20 and the receiving drum 21. The distance between the axes of the rollers 38 is adjustable.

The overlapping drum 30 is positioned near a gripping drum 43 which folds the sheets of the printed papers 27 and a sheet delivery drum 44 and operates supply and receive the sheets to and from the drums 43 and 44.

The overlapping drum 30 is provided with a plurality of long fingers 39, short fingers 40 and insertion spatulas 41 extending in the longitudinal direction thereof and operated by a cam mechanism. Where the diameter $D_2$ of the overlapping drum 30 is three times of the diameter $D_1$ of the cutting drum as in this embodiment, it is advantageous to provide three pairs of equally spaced long fingers 39, short fingers 40 and insulation spatulas 41.

The purpose of the long fingers 39 is to grip the sheets of the printed papers 27 which are transferred by the conveyor for transferring the sheets by clamping them between the belt 42 which is driven to move along the surface of the overlapping drum 30, and the surface of the overlapping drum 30. Where each sheet is to be folded once in the transverse direction, as shown in FIG. 5D, a cam $\mathbf{39}_{a1}$ associated with a long finger 39 makes one revolution per one revolution of the overlapping drum 30 whereby the long finger 39 is operated once when the overlapping drum 30 rotates one revolution as shown by the contour $\mathbf{39}_{b1}$ of the cam $\mathbf{39}_{a1}$. At this time, the short finger 40 is held closed. For this reason, a cam $\mathbf{40}_{a1}$ for the short finger 40 is made circular.

Figure 6A:
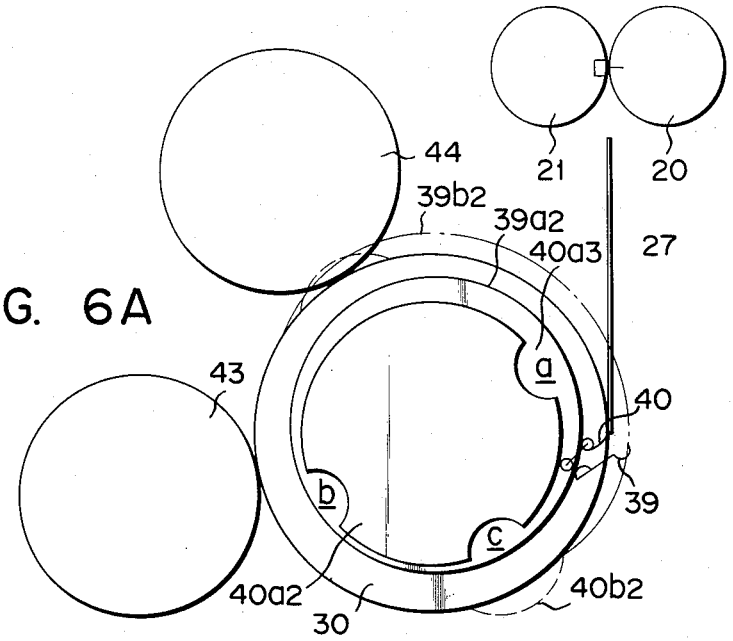
Figure 6B:
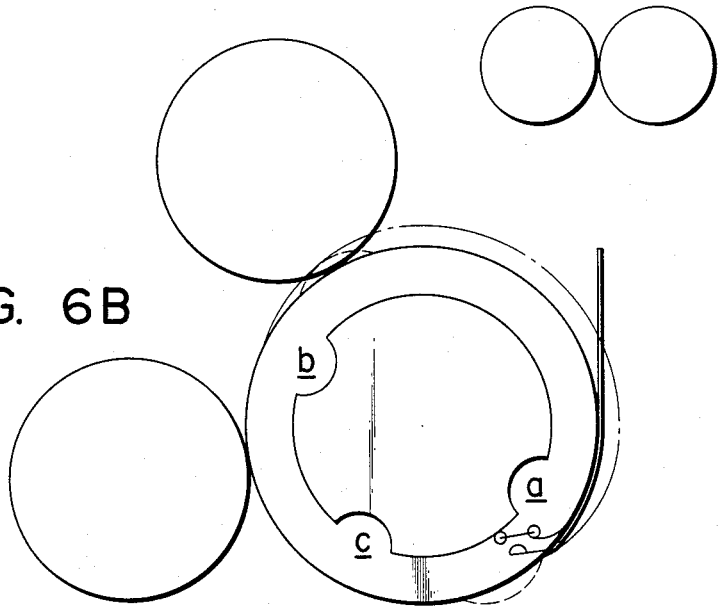

When two sheets of the printed papers 27 are to be overlapped by long and short fingers 39 and 40, and then transferred to the sheet delivery drum 44, the long finger 39 is operated in the same manner as in the case of folding so that the cam $\mathbf{39}_{a2}$ is made to have the same contour as cam $\mathbf{39}_{a1}$.

Where two sheets of printed papers 27 are overlapped and delivered, a cam $\mathbf{40}_{a2}$ associated with the short finger 40 is provided with three grooves $\mathbf{40}_{a3}$ for operating the short finger 40 as shown in FIG. 6A. Of these grooves, a first groove a is used to operate short finger 40 adapted to grip the first sheet of the printed paper 27, a second groove b is used to operate the short finger 40 so that it will grip a second sheet of printed paper 27*a* for superposing the second sheet on the first sheet and a third groove c is used to simultaneously release two sheets of printed papers 27 and 27*a*. For this reason it is constructed such that as the platen drum of the printing unit makes one revolution, the overlapping drum 30 makes $\frac{1}{3}$ revolution, cam $\mathbf{40}_{a2}$ makes $\frac{1}{2}$ revolution and the short finger is operated once. Accordingly, as the cam $\mathbf{40}_{a2}$ makes one revolution (in which the overlapping drum 30 makes $\frac{2}{3}$ revolution) the short finger 40 would be operated twice.

Although in the foregoing embodiment, three pairs of long and short fingers 39 and 40 and the insertion spatulas 41 were used where $D_2=3D_1$, it should be understood that the invention is not limited to such specific design and that M pairs of the long and short fingers 39 and 40 and the insertion spatulas 41 can be used for $D_2=MD_1$ (where M is an integer larger than 2).

Although in a case where two folded sheets are delivered, three grooves $\mathbf{40}_{a3}$ were provided for cam $\mathbf{40}_{a2}$ associated with the short finger 40, according to this invention where the number of overlapped sheets of the printed papers to be delivered is n (n represents an integer) the number of the grooves of the cam $\mathbf{40}_{a2}$ may be selected to be $(n\times 1)$. In other words, in such a case, while in the case shown in FIG. 6A, the state of the long finger 39 is changed from "close" to "open" between the gripping roller 43 and the delivery roller 44 by the contour $\mathbf{39}_{b2}$ of the cam $\mathbf{39}_{a2}$, the contour of the cam $39_{b3}$ may be changed such that the state of the long finger is changed from "close" to "open" at a position where the overlapping drum 30 and the delivery drum 44 approach each other.

The gripping drum 43 is constructed to have a diameter $D_3$ twice of that $D_1$ of the cutting drum 20. The gripping drum 43 is provided with a plurality of longitudinary extending spatulas 45 and jaws 46 which are operated by a well known cam mechanism.

A sheet of printed paper 27 which has been gripped by the long finger 39 is released therefrom when an insertion spatula 41 of the overlapping drum 30 and the gripping spatula 45 of the gripping drum 43 align each other, and the released sheet 27 would be gripped and folded (once in the transverse direction) by the gripping spatula 45 and the jaw 46 and then released from the gripping spatula 45 and the jaw 46 at the paper separating plate 61 onto a paper conveyor 47.

Although in this embodiment, where $D_3=2D_1$, two pairs of the gripping spatulas 45 and jaws 46 and used, it should be understood that the invention is not limited to such particular member of pairs, and that, where $D_3=ND_1$ (N is an integer) N pairs of the gripping spatulas and jaws may be provided.

The diameter $D_4$ of the delivery drum 44 is made to the twice of the diameter $D_1$ of the cutting drum 20. The delivery drum 44 is provided with a plurality of pairs of delivery fingers 55 extending in the longitudinal direction of the drum and operated by a well known cam mechanism.

Two overlapped sheets of the printed papers 27 which have been gripped by the short finger 40 of the overlapping drum 30 would be released from the short finger 40 when the finger 40 and the delivery finger 55 of the delivery drum 44 coincide each other and the released sheets would be gripped by the delivery finger 55 and then released therefrom at a paper separating plate 42. While in this embodiment diameter $D_4$ was selected to be equal to $2D_1$ in a case where L overlapped sheets are to be delivered it is possible to make $D_4=LD_1$, where L represents an integer.

Turning now to the conveyor mechanism, it comprises a chopper blade 48, a transverse folding impeller 49 and a chipper impeller 50 which may be of a well known construction. The conveyor mechanism also comprises a stationary conveyor 51 which conveys sections folded once in the transverse direction or chopper folded in an overlapped state like tiles, and a movable conveyor 52 which conveys to and stacks the sections 54 on a movable stacker 53. There is provided a second conveyor unit 56 comprising an upper belt **57*a* and a lower belt 57*b* which clamp and convey one or two sheets of overlapped printed papers 27 and are driven at the same speed as the peripheral speed of the delivery drum 44. The rear end of the upper belt 57*a* is wrapped about the delivery drum 44**. The upper and lower belts are driven at high speeds.

A kick pin 58 is located near the leading end of the lower belt **57*b* and within the loop of the upper belt 57*a*. When the kick pin 58 is rotated in the clockwise direction it kicks down the trailing end of the sheet of the printed paper 27 which has been conveyed at a high speed. The kicked down sheets 27 are clamped and stacked like tiles between low speed upper and lower belts 59*a* and 59*b* and conveyed at low speed to be stacked on a paper stack pedestal 60, which is moved in the vertical direction in accordance with the height of the stacked sheets 27**.

The folding machine of this invention operates as follows:

At first, a case wherein the illustrated machine is used as a folding machine to deliver a web of a printed paper 9 as sections will be described with reference to FIGS. 5A through 5D. At this time, the delivery drum 44 is stopped and the cam $40_{a1}$ for the short finger 40 is maintained at a closed position. Accordingly, the contour of cam $40_{a1}$ is shown by solid lines in FIG. 5A.

When the web of the printed paper 9 is cut into sheets of printed papers 27 having a predetermined length by the cutting drum 20 and the receiving drum 21, the sheets are conveyed to the overlapping drum 30 by being clamped between the conveyor belt 28 and belt 42.

Figure 5A:
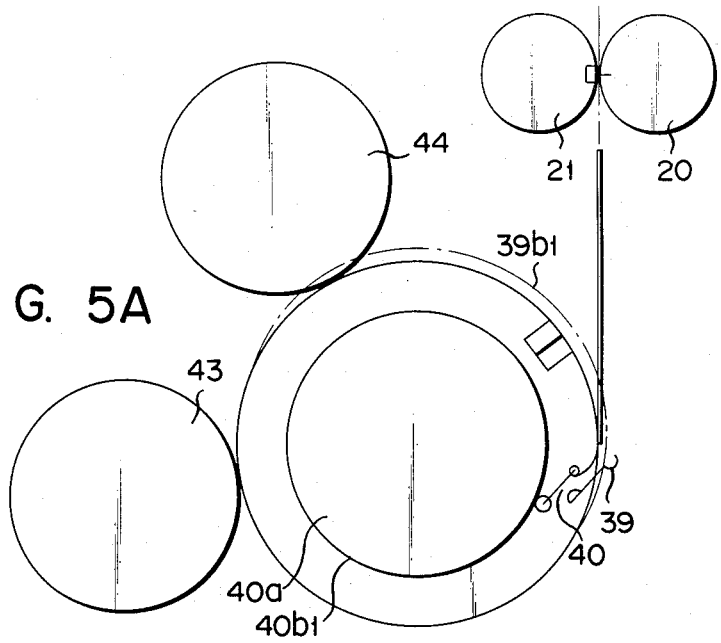
FIGS. 5A to 5D and FIGS. 6A to 6L are diagrams useful to explain the operation of the folding machine of this invention.
Figure 5B:
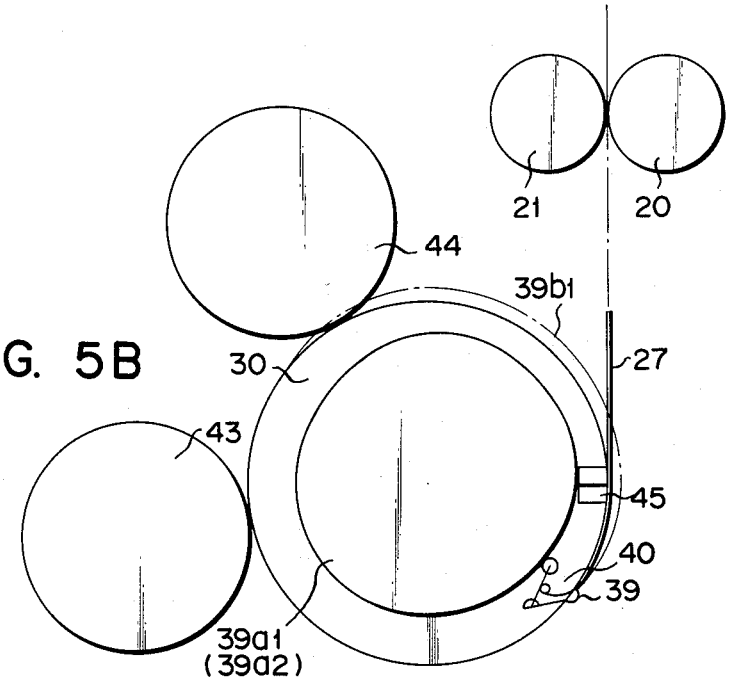

In the position shown in FIG. 5A since the long finger 39 is opened by the contour $30_{b1}$ of the cam $39_{a1}$ shown by dot and dash lines, the leading ends of the sheets are advanced to the long finger 39. When this finger is closed by the contour $39_{b1}$ of the cam $39_{a1}$ as a result of rotation of the overlapping drum 30, the sheets 27 would be gripped by the long finger 39 as shown in FIG. 5B to be clamped between the surface of the overlapping drum 30 and the belt 42 (see FIG. 1). Thus the sheets are wrapped about the periphery of the overlapping drum 30.

Figure 5C:
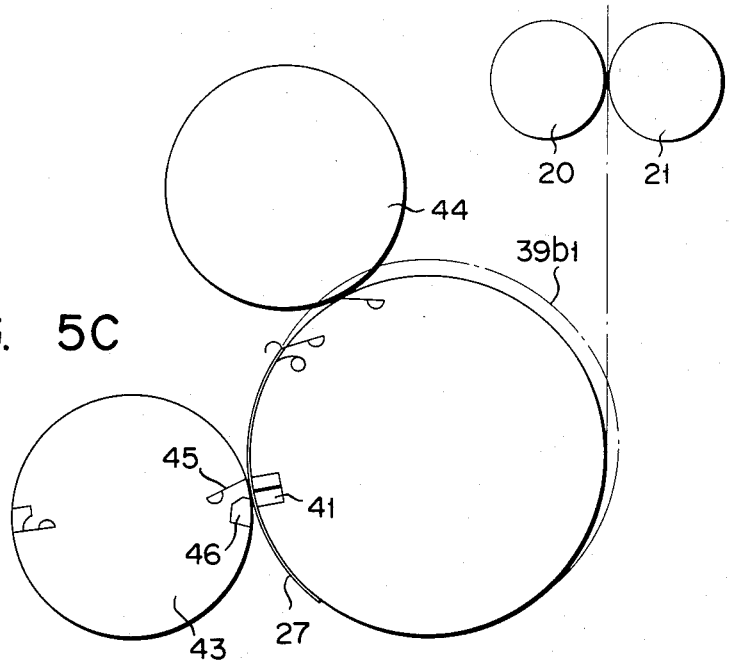
Figure 5D:
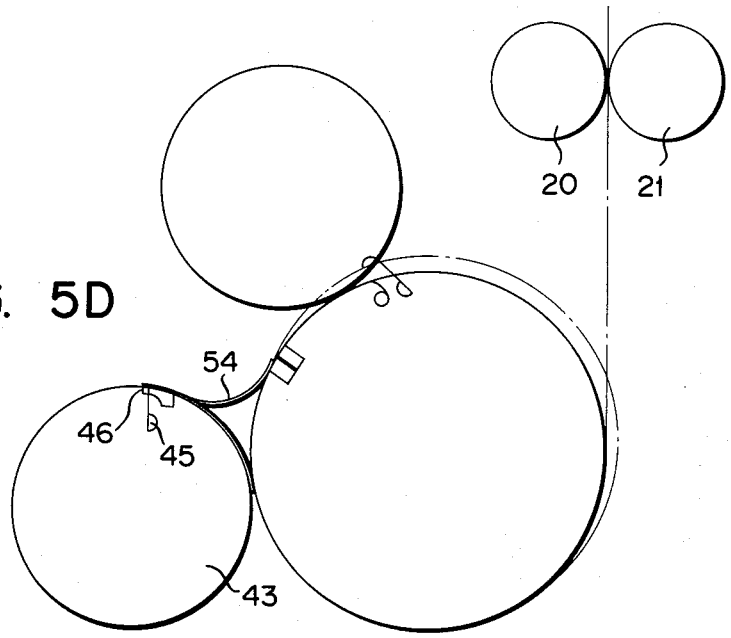

As shown in FIG. 5C when the insertion spatula 41 of the overlapping drum 30 comes in alignment with the gripping spatula 45 of the gripping drum 43, the long finger 39 would release the sheets 27, and the inserting spatula transfers the sheets to the gripping spatula and the jaw 46. Then the sheets 21 are formed into sections 54 by the rotation of the gripping drum 43 as shown in FIG. 5D. Thereafter, the sections 54 are transferred to delivery conveyor 47 and then to transverse impeller 49, from which the sheets are stacked on the movable conveyor 52 like tiles. The sections conveyed by the conveyor 52 are stacked on the movable stacker 53. Where the sections 54 are chopper folded, the sections 47 conveyed by the delivery conveyor 47 are chopper folded by the chopper impeller 50 to be stacked like tiles. Thereafter the sections are stacked on the movable stacker 53 in the same manner as above described.

A case wherein the machine is operated as a sheet delivery machine; that is, the sheets of the printed paper 27 are delivered, will now be described with reference to FIGS. 6A through 6L. At this time the gripping drum 43 is stopped.

The sheets of printed papers 27 cut into predetermined length by the cutting drum 20 and the receiving drum 21 are sent to the overlapping drum 30 by being clamped between the conveyor belt 28 and the belt 42.

In a condition shown in FIG. 6A, as the longer finger 39 is opened by the contour $39_{b2}$ (shown by dot and dash lines) of the cam $39_{a2}$, the leading edges of the sheets are conveyed to a position beneath the long finger 39, whereas the short finger 40 is held closed as in the case where the locus of the cam $40_{a2}$ has a contour suitable for folding.

As the overlapping drum 30 rotates and the long finger 39 is closed by the contour $39_{b2}$ (shown by solid lines) of the cam $39_{a2}$ the sheets of the printed paper 27 would be gripped by the long finger 39 and wrapped about the overlapping drum 30 which being clamped between the periphery of the overlapping drum 30 and the belt 42.

Figure 6C:
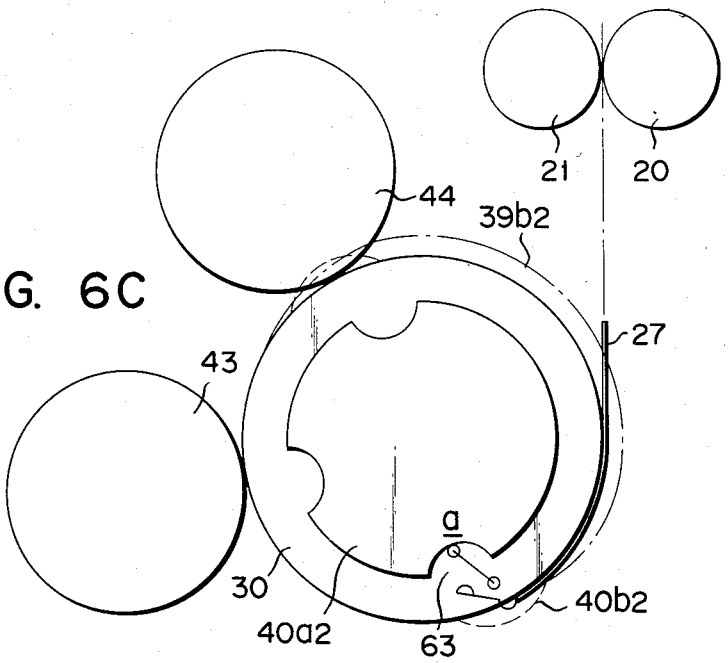
Figure 6D:
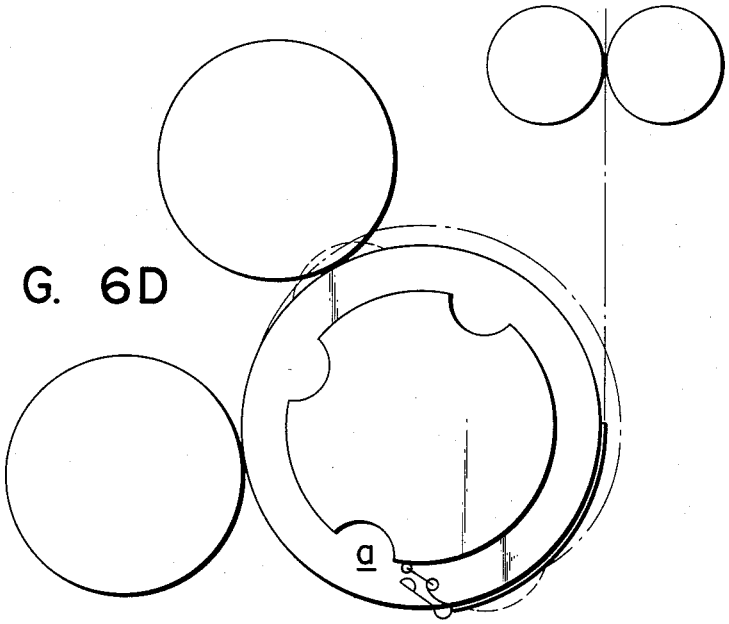

Under a condition shown in FIG. 6C wherein the leading end of the sheet of printed paper 27 is gripped by the long finger 39, when cam mechanism 63 brings the short finger 40 to the groove a of the cam $42_{a2}$, the short finger 40 will move along contour $40_{b2}$ to change its state from "open" to "close" to grip the leading edge of the sheet 27. Accordingly, the sheet 27 is gripped by the long finger 39 and the short finger 40 as shown in FIG. 6D.

Figure 6E:
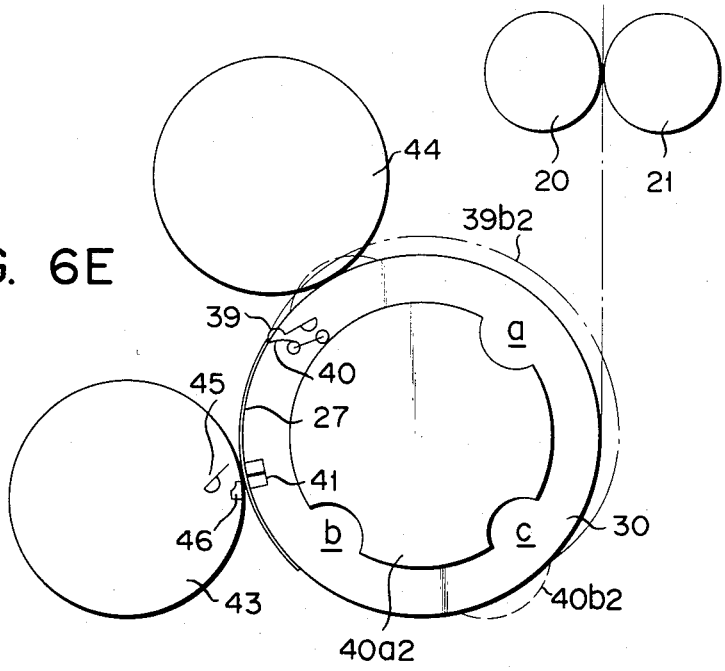

When the long finger 39 and the short finger 40 reach a position in front of the delivery drum 44, that is when the long finger 39 comes to a position where the insertion spatula 41 of the overlapping drum 30 at the time of folding once in the transverse direction aligns with the gripping drum 45 the long finger 39 begins to open as shown in FIG. 6E. On the other hand, the short finger 40 is still maintained in the closed state, so that the sheet 27 is gripped by the short finger 40.

Figure 6F:
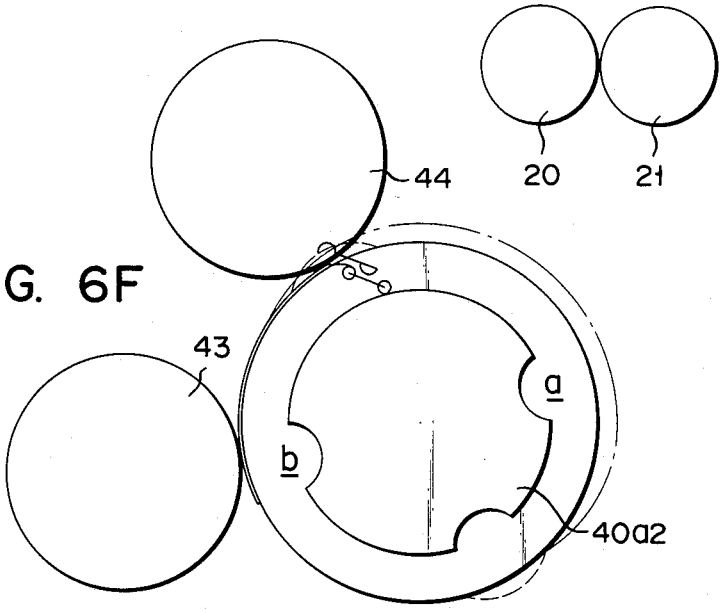
Figure 6G:
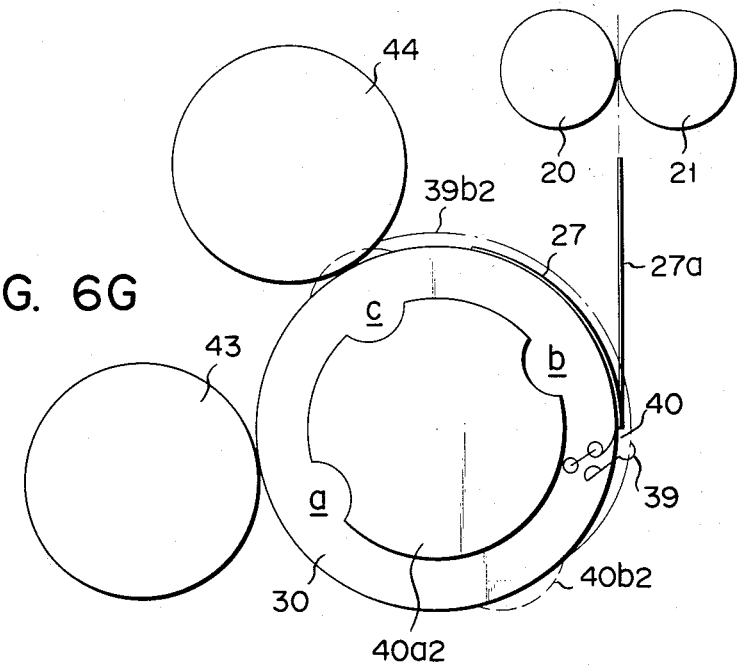

Then, as shown in FIG. 6F, the first sheet 27 is wrapped about the overlapping drum 30 while being gripped by the short finger 40 so that when this drum is rotated one revolution to bring the long finger 39 to the position shown in FIG. 6A, the second sheet of the printed paper 27*a* will be brought to opened long finger 39 by the conveyor belts 23 and 42.

Figure 6H:
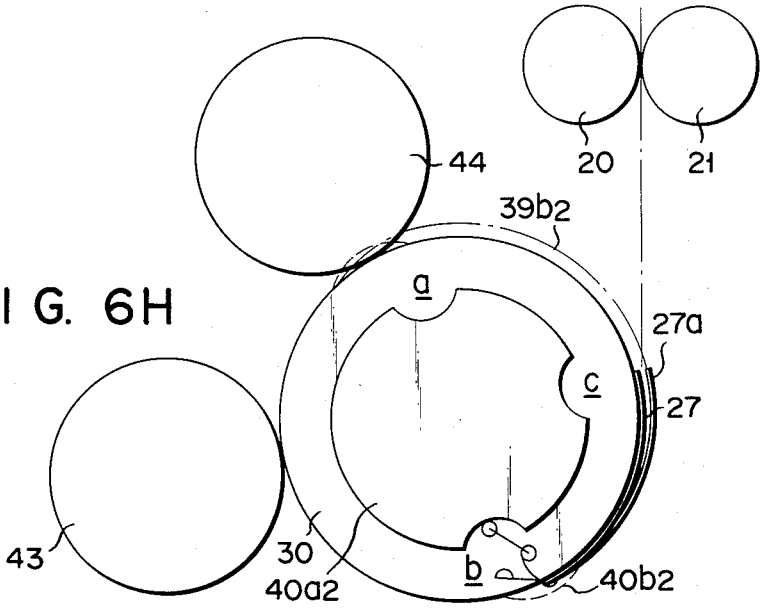
Figure 6I:
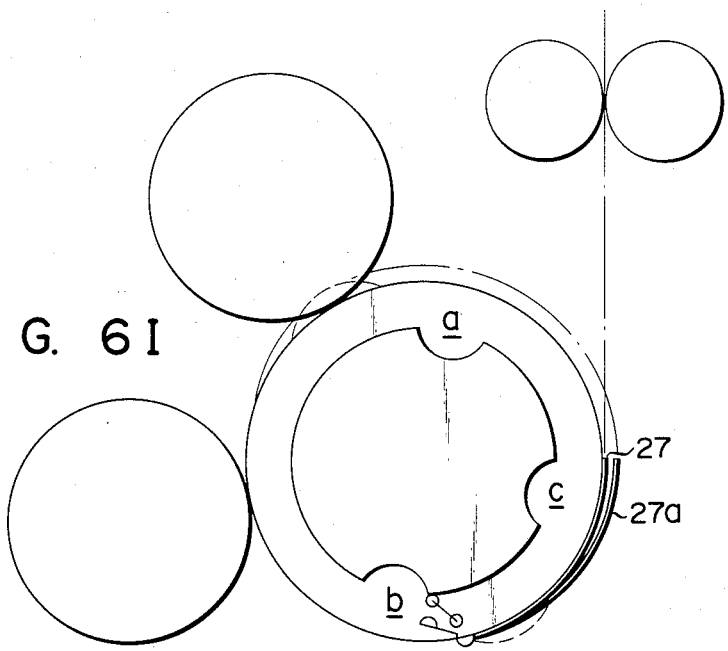
Figure 6J:
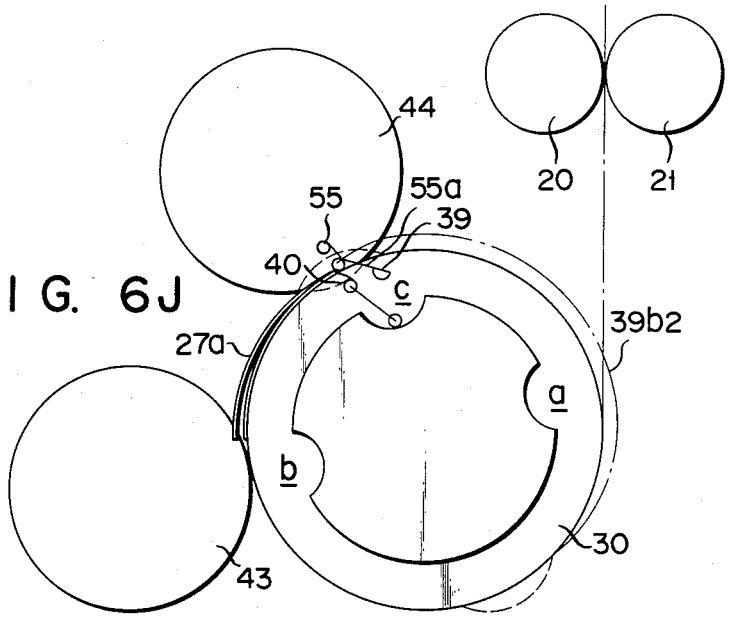
Figure 6K:
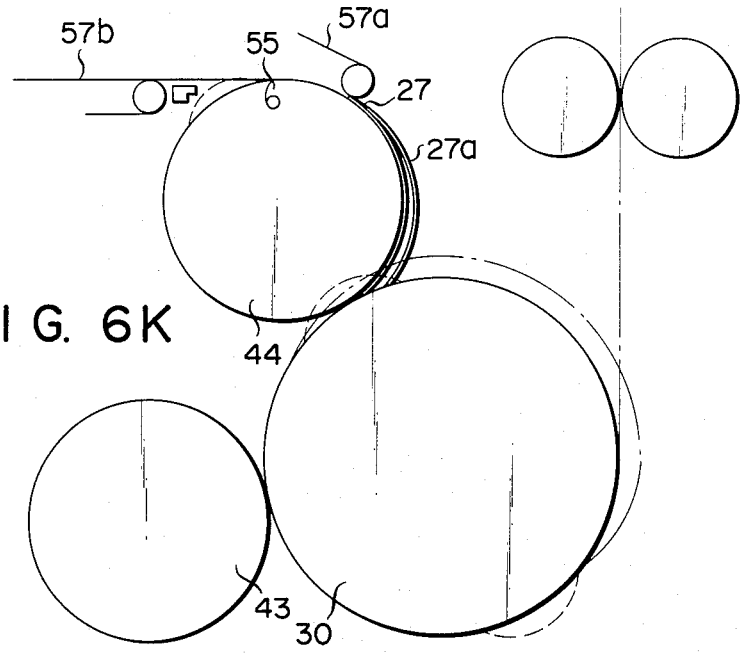
Figure 6L:
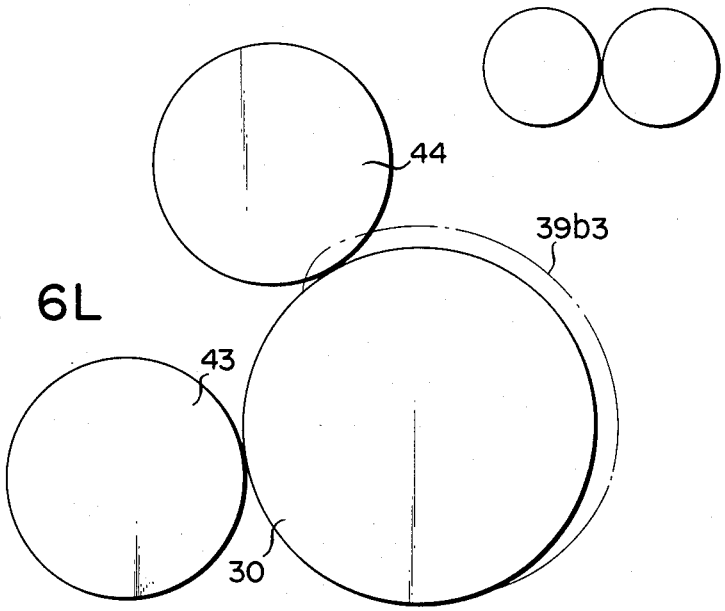

When the overlapping drum 30 is rotated further to close the long finger 39 while the first sheet 27 is being gripped by the short finger as shown in FIG. 6H, the sheet 27 is overlapped on the second sheet 27*a* and these sheets are gripped by the long finger 39. Then when the state of the short finger 40 changes from "close" to "open" as shown FIG. 6I the sheets 27 and 27*a* are continued to be gripped by the short and long fingers 39 and 40. Thus while being overlapped the first and second sheets 27 and 27*a* are wrapped about the overlapping drum 30 and when the short finger 40 of the overlapping drum 30 comes to coincide with the delivery finger 54 of the delivery drum 44, the short finger 40 is opened to simultaneously release both sheets 27 and 27*a*. Since at this time, the delivery finger 55 is closed by the locus $55_{a1}$ of a well known can mechanism, the released sheets 27 and 27*a* would be gripped by the delivery finger 55.

Accordingly, the sheets 27 and 27*a* are transferred to the delivery drum 44 from the overlapping drum 30. On the other hand, the state of the short finger 40 is changed from "open" to "close" as shown in FIG. 6A to grip the next sheet of printed paper.

The sheets 27 and 27*a* transferred to the delivery drum 44 are wrapped thereabout and the delivery finger 55 is opened when it comes to the separating plate 62.

As a consequence, the sheets 27 and 27*a* are released from the delivery finger 55 to form overlapped sheets 64 which are clamped between the upper and lower high speed belts 57*a* and 57*b* and conveyed thereby. Then the overlapped sheets 64 are kicked down onto the low speed belt 59 by the kick pin 58. The sheets are then conveyed while being stacked like tiles and stacked on the stack pedestal 60.

Figure 2:
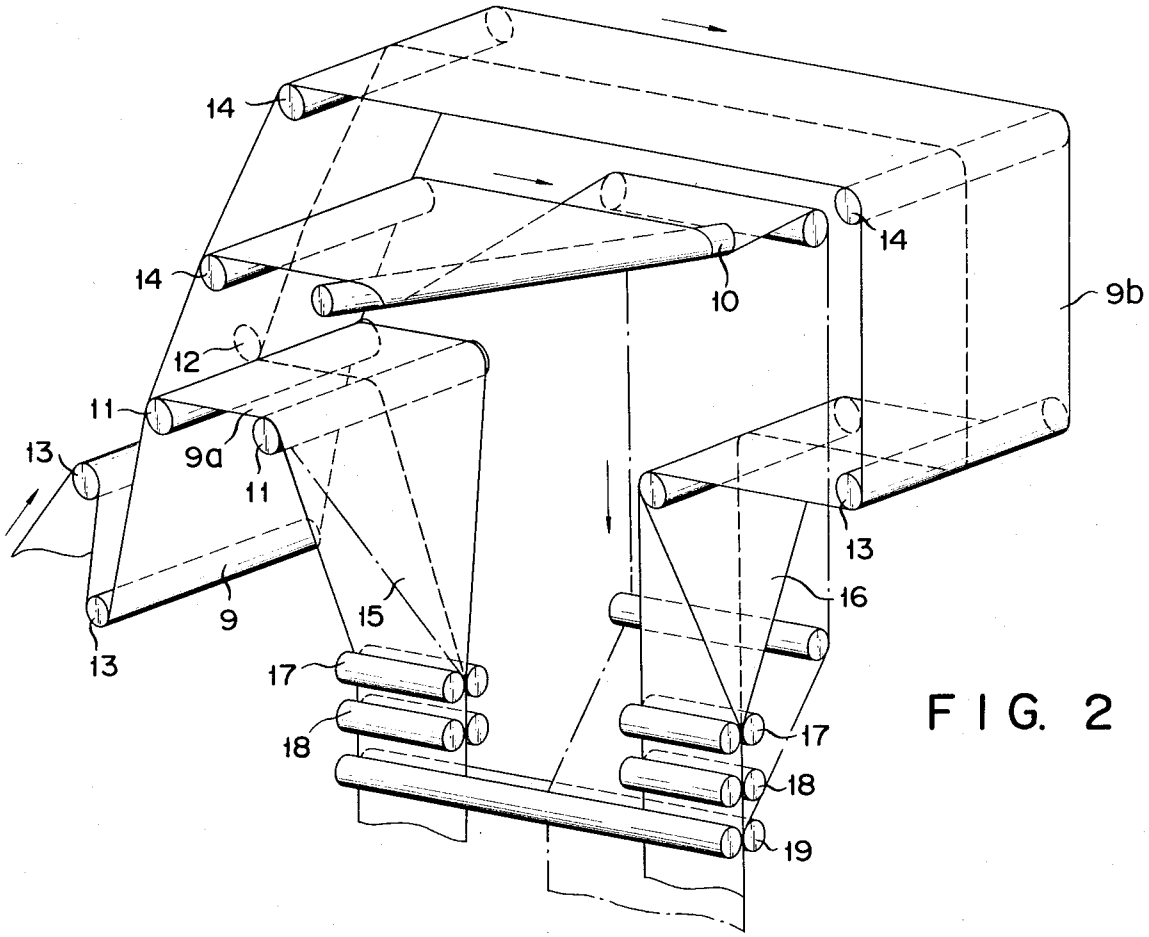
FIG. 2 is a diagrammatic perspective view showing a path of a web shaped printed paper entering into the folding machine.

With reference to FIG. 2, the relationship between the path of movement of the web of printed paper 9 and the section 54 and sheet 64 delivered by the machine of this invention will be described as follows.

Figure 7A:
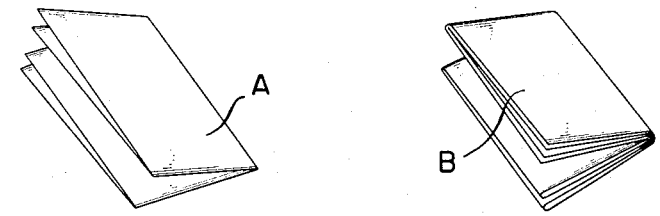
FIGS. 7A and 7B are perspective views of the folded papers prepared by a different embodiment of this invention.

When the slitter 12 is not used and when the web of the printed paper 9 introduced into the folding machine along path 9*b* is folded in the longitudinal direction by the right hand triangular plate 16 the section 54 comprises an 8 page section A and a 16 page section B as shown in FIG. 7A and delivered by the folding machine.

Figure 7B:
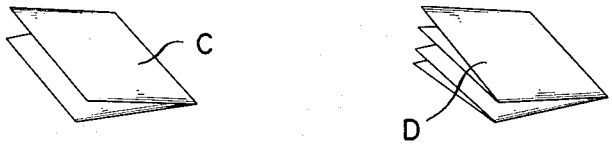

Furthermore, when the slitter 12 is not used and when the web passing through a path 9*a* is folded in the longitudinal direction by a left hand triangular plate 15, an 8 page section A or a 16 page section B as shown in FIG. 7A is delivered.

Where the web of the printed paper is divided in the longitudinal direction by the slitter 12 and webs of printed papers 9*a* and 9*b* each having a width of one half are guided to the folding machine through the left and right triangular plates 15 and 16 the directions of advancement of two webs 9*a* and 9*b* are changed by the triangular plates 15 and 16 and the webs are delivered in two rows to form a 4 page section C or an 8 page section D as shown in FIG. 7B.

When a web of the printed paper 9 is cut at a right angle bend with the turn bar 10 without using the slitter 12, the overlapped sheets 64 are delivered from the folding machine.

As above described according to this invention, a web of a printed paper is folded with a group of folding drums, and sheets or sections of printed papers are delivered without using a needle device so that it is not necessary to trim for improving the appearance or remove needle openings thus simplifying the machine and decreasing cost.

Moreover, as the sheets and sections are discharged in the same direction many component parts of the machine such as the driving device, cutting device and machine frame, etc. can be used in common thus decreasing the cost of manufacturing and installation. Use of a turn bar enables delivery of sheets having equal width as that of the original web of printing paper.

What we claim is:

1. A combination machine for selectively transporting paper sheets along one of two alternative paths, one path being a folding path for causing the paper sheets to be folded, and the other path being a delivery path which allows introduced paper sheets to pass therealong without being folded while in said other path, for use in a rotary press, comprising:

a cutting unit which cuts a web of printed paper into a plurality of sheets of printed papers, each sheet having a predetermined length, said cutting unit supplying said sheets separated from each other;

a conveyor unit for clamping and conveying said sheets of printed papers;

a rotatable overlapping drum including a long finger and a short finger for holding a sheet or a plurality of sheets on the overlapping drum, and an insertion spatula mounted on said rotatable overlapping drum for use in producing a fold in the sheets when they pass along the folding path;

cam means operatively coupled to said fingers to cause said fingers to overlap and grip one or a plurality of the sheets of printed papers conveyed to said overlapping drum by said conveyor unit;

a rotatable, selectively operable gripping drum being positioned adjacent said overlapping drum and having a jaw for gripping and folding said sheets of printed papers as the sheets pass along the folding path;

a rotatable, selectively operable sheet delivery drum positioned adjacent said overlapping drum for receiving a plurality of sheets of printed papers from said overlapping drum, said delivery drum including at least one delivery finger for holding the paper sheets to the delivery drum as it rotates; said gripping drum and said delivery drum effecting transport of the paper sheets respectively along the folding path and delivery path without perforating said sheets and without requiring a separate sheet-holding means;

means for causing said overlapping drum to selectively cooperate with said gripping drum and said sheet delivery drum and including means for directing said paper sheets either to said gripping drum in said folding path or to said delivery path for respectively folding a sheet or delivering overlapped sheets;

first holding means (60) for stacking and horizontally holding overlapped sheets;

first transfer means (56) extending in a given direction from adjacent said delivery drum (44) to said first holding means for transferring sheets from said delivery drum to said first holding means;

second transfer means (51,52) located below and spaced vertically apart from said first transfer means (56) and extending from adjacent said gripping drum (43) in a given direction for transferring sheets from said gripping drum in said given direction, said second transfer means having an inlet side adjacent said gripping drum (43) and an outlet side;

second holding means (53) for holding sheets folded in said folding path with the folded sheets extending in a vertical direction, said second holding means being provided on said outlet side of said second transfer means for receiving folded sheets therefrom; and said first and second transfer means extending substantially in the same given direction.

2. The combination machine of claim 1, wherein said second transfer means comprises a delivery conveyor (51) for conveying folded sheets discharged from said gripping drum; and a movable conveyor (52) for conveying said sheets being folded, in a stacked state like tiles to said second holding means (53).

3. The combination machine of claim 1, wherein said first transfer means (56) comprises a high speed conveyor (57) which conveys one or a plurality of stacked sheets discharged from said delivery drum; and a low speed conveyor (59) which receives said one or a plurality of sheets from said high speed conveyor and conveys the sheets to said first holding means (60).

4. The combination machine of claim 3, wherein said high speed conveyor is located vertically higher than said low speed conveyor.

5. The combination machine of claim 3, wherein said first transfer means further comprises a kick pin for pushing the rear edge of a sheet on said high speed conveyor to locate the pushed sheet above the preceding sheet disposed on the low speed conveyor, thereby assisting in the transference of a sheet from said high speed conveyor to said low speed conveyor and neatly stacking the transferred sheets.

6. A combination machine for selectively transporting paper sheets along one of two alternative paths, one path being a folding path for causing the paper sheets to be folded, and the other path being a delivery path which allows introduced paper sheets to pass therealong without being folded while in said other path, for use in a rotary press, comprising:

a slitter for longitudinally slitting a web of printed paper into two halves;

a pair of triangular plates for receiving the paper from said slitter for longitudinally folding slitted halves of the web;

a cutting drum for receiving the folded halves of the web from said triangular plates for transversely cutting the folded halves into sheets of printed papers each having a predetermined length;

a rotatable overlapping drum having a plurality of gripping fingers for holding a sheet or a plurality of sheets on the overlapping drum and an insertion spatula for use in producing a fold in the sheets when they pass along said folding path;

cam means operatively coupled to said gripping fingers to cause said gripping fingers to grip sheets of folded papers;

a first belt conveyor means for conveying the sheets of printed papers from the cutting drum to said overlapping drum by clamping and conveying said sheets between the surface of said overlapping drum and said first belt conveyor means;

a rotatable, selectively operable gripping drum positioned adjacent said overlapping drum and including a plurality of pairs of jaws for receiving and folding the sheets from said overlapping drum as the sheets pass along the folding path;

a second belt conveyor means extending in a given direction from adjacent said gripping drum to receive the folded sheets therefrom and convey the sheets to a first stacking station which stacks and holds the conveyed sheets, said second belt conveyor means having an inlet side adjacent said gripping drum and an outlet side;

a rotatable, selectively operable sheet delivery drum positioned adjacent said overlapping drum for receiving a plurality of sheets from said overlapping drum, said delivery drum including a plurality of fingers for receiving and delivering the sheets from said overlapping drum, said gripping drum and said delivery drum effecting a transport of the paper sheets respectively along the folding path and delivery path without perforating said sheets and without requiring a separate sheet-holding means; and a third belt conveyor means operatively associated with and extending in a given direction from adjacent said delivery drum to receive the sheets therefrom and to convey the sheets to a second stacking station which stacks and holds the sheets conveyed thereto said third belt conveyor means having an inlet side adjacent said delivery drum and an outlet side;

said second and third belt conveyor means extending from said gripping drum and delivery drum, respectively, substantially in the same given direction, said second belt conveyor means being located below and spaced vertically apart from said third belt conveyor means;

said first stacking station being located at the outlet side of said second belt conveyor means, and said second stacking station being located below said first stacking station, in the vertical direction and at the outlet side of said third belt conveyor means; and means for causing said overlapping drum to selectively cooperate with one of said gripping drum and said sheet delivery drum and including means for directing said paper sheets either to said gripping drum in said folding path or to said delivery path for respectively folding a sheet or delivering overlapped sheets.

7. The combination machine of claim 6, comprising means for selectively maintaining said delivery drum and said third belt conveyor means associated therewith inoperable such that sections of printed papers are delivered from said gripping drum to said first stacking station.

8. The combination machine of claim 6, comprising means for selectively maintaining said gripping drum and said second belt conveyor means associated therewith inoperable such that sheets of printed papers are delivered to said delivery drum.

9. The combination machine of claim 6, wherein said third belt conveyor means associated with said delivery drum comprises a high speed conveyor means which conveys one or a plurality of sheets discharged from said delivery drum, and a low speed conveyor means which receives said sheets from said high speed conveyor means and conveys said sheets to said second stacking station.

10. The combination machine of claim 9, wherein said third belt conveyor means further comprises a kick pin for pushing the rear edge of a sheet to locate the pushed sheet above the preceding sheet disposed on said low speed conveyor means, thereby assisting in the transference of a sheet from said high speed conveyor means to said low speed conveyor means and neatly stacking the transferred sheet at said second stacking station.

* * * * *